United States Patent [19]

Lundbladh

[11] 4,249,583

[45] Feb. 10, 1981

[54] DEVICE FOR EVACUATING AIR FROM A CONTAINER

[76] Inventor: Tage S. Lundbladh, 85 Vilgergagatan, 603 57 Norrkoping, Sweden

[21] Appl. No.: 61,081

[22] Filed: Jul. 26, 1979

Related U.S. Application Data

[63] Continuation of Ser. No. 853,964, Nov. 22, 1977, abandoned.

[30] Foreign Application Priority Data

Sep. 16, 1977 [SE] Sweden ..... 7710400

[51] Int. Cl.[3] ..... B65B 31/04

[52] U.S. Cl. ..... 141/65; 116/268; 116/270; 141/95

[58] Field of Search ..... 141/7, 8, 65, 66, 95, 141/348; 116/268, 270

[56] References Cited

U.S. PATENT DOCUMENTS

| | | | |
|---|---|---|---|
| 1,601,705 | 9/1926 | Staunton | 141/65 X |
| 2,648,474 | 8/1953 | Crook | 141/65 X |
| 3,135,411 | 6/1964 | Osborne | 141/65 X |
| 3,313,444 | 4/1967 | Katell | 141/65 X |
| 3,841,366 | 10/1974 | Vaughn | 141/348 X |

*Primary Examiner*—Frederick R. Schmidt
*Attorney, Agent, or Firm*—William A. Drucker

[57] ABSTRACT

A device for evacuating air from a container comprises a closing cover, to sealingly close an opening of a container, having an opening closable by a valve. The closing cover further has at its upper surface an annular flange surrounding the opening therein. The device also comprises a separable evacuating pump having a cylinder which may be sealingly connected to the closing cover by pressing the cylinder over the flange until the end surface of the cylinder engages the part of the closing cover from which the annular flange projects, in order to achieve a sealing action in two planes substantially perpendicular to each other, and also locking the pump against lateral displacement relative to the closing cover.

7 Claims, 4 Drawing Figures

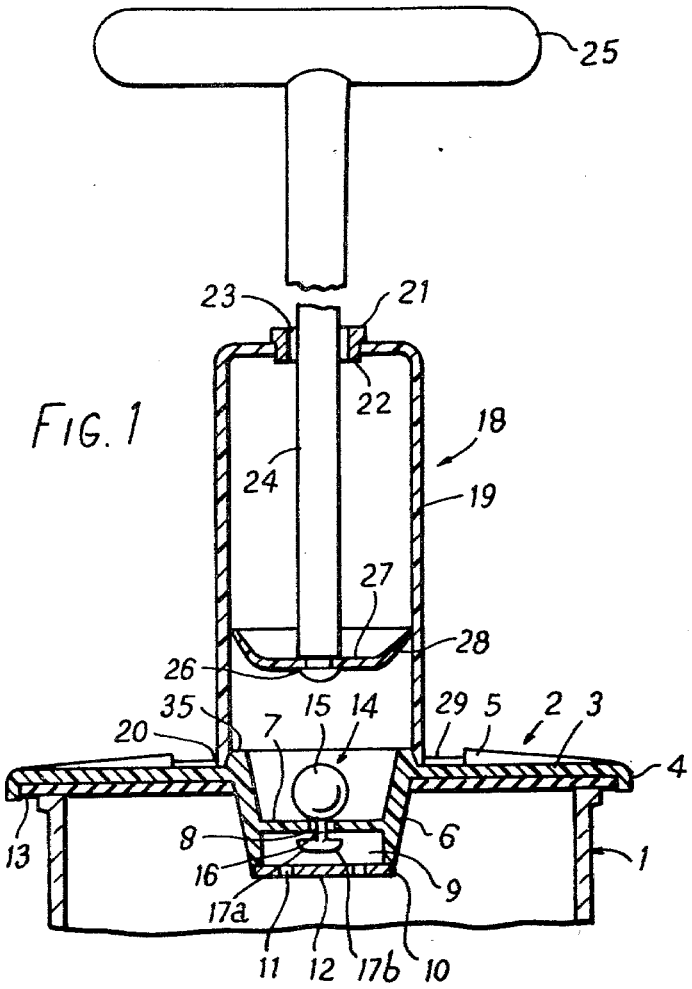
FIG. 1
FIG. 2
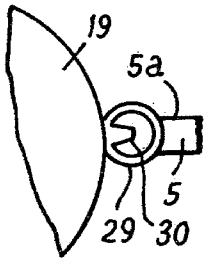
FIG. 3
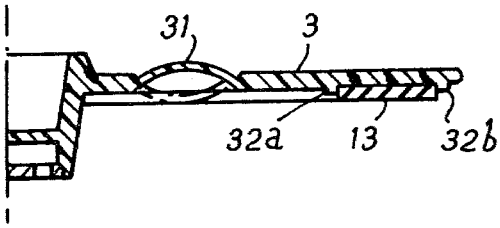
FIG. 4
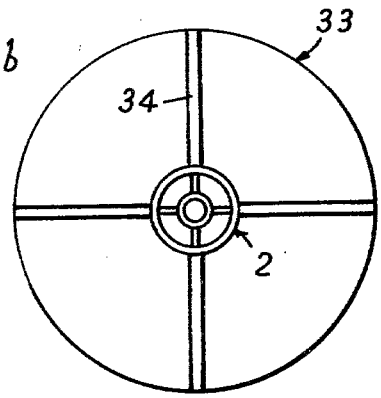

DEVICE FOR EVACUATING AIR FROM A CONTAINER

CROSS REFERENCE TO RELATED APPLICATIONS

This is a continuation application of my prior application Ser. No. 853,964, filed Nov. 22, 1977, now abandoned.

BACKGROUND OF THE INVENTION

FIELD OF THE INVENTION

This invention relates to a manual device for evacuating air from a container, and more particularly to a device utilizing a sealing cover provided with a valve, and a separate suction pump to cooperate with said cover.

Devices for evacuating air manually from containers have been well known for many years. Continuing efforts have been made to develop such devices which are inexpensive to manufacture and easy to operate, such that they can be used in the household as well as in restaurants and industries.

BRIEF SUMMARY OF THE INVENTION

The primary object of this invention to provide a device, for evacuating air from containers, which comprises a closing cover provided with a valve, and a separable suction pump to cooperate with said cover.

It is another object of this invention to provide an improved device, for evacuating air from containers, whose cover and pump have cooperating parts to provide a sealing as well as a locking effect upon the cover and pump during the operation of the device.

It is a further object of this invention to reduce the cost and improve the operational performance of such a device.

Additional objects and advantages of the invention will be set forth in part in the description which follows, and in part will be obvious from the description, or may be learned by practice of the invention. The objects and advantages of the invention may be realized and attained by means of the instrumentalities and combinations particularly pointed out in the appended claims.

To achieve the foregoing objects and in accordance with the purpose of the invention, as embodied and broadly described herein, the device of this invention comprises a closing cover which has a sealing surface provided to sealingly close the opening of the container, said closing cover having also an opening which is normally closed by means of a valve provided to open in response to a relative overpressure in said container and a separable evacuating pump adapted to be sealingly connected to said closing cover. The upper surface of said closing cover has an annular flange surrounding said opening in said cover and is adapted to sealingly engage outer and/or inner surfaces of a cylindrical suction member of said pump by pressing said suction member against the closure at the same time as the upper side of said closing cover seals the end portion of said pump member, in order to obtain a sealing action in two planes which are substantially perpendicular to each other, as well as locking said suction member against lateral displacement relative to said closing cover.

BRIEF DESCRIPTION OF THE DRAWINGS

The accompanying drawings, which are incorporated in and constitute a part of this specification illustrate one embodiment of the invention and, together with a description, serve to explain the principles of the invention. In the drawings:

FIG. 1 is a cross section of an embodiment of the device of the invention, seen applied to the opening of a can or similar container;

FIG. 2 is a plan view of part of the suction pump of FIG. 1, and an adjacent portion of the cover of FIG. 1;

FIG. 3 is a partial cross section of a modified cover of the device of FIG. 1, and FIG. 4 is a plan view of a second modification of the cover of FIG. 1.

DETAILED DESCRIPTION OF THE PREFERRED EMBODIMENT

Reference will now be made in detail to the preferred embodiment of the invention illustrated in the accompanying drawings.

Referring to FIG. 1 it will be seen that the opening of a container, such as a glass jar 1, only the upper portion of which is shown, is covered by a closing cover 2 forming part of the device to be described. In the preferred embodiment of the invention, said cover is made from a plastics material by an injection molding process, and comprises a substantially planar disc shaped portion 3 which, at the outer portion thereof, has a downwardly directed circumferential flange 4. The closing cover has a number of reinforcement ribs 5 projecting from the upper side thereof and extending substantially radially, and a centrally-located downwardly directed socket 6 having intermediate its top and bottom ends a separating wall 7 provided with a centrally-located opening 8. The space 9 below said wall 7 is normally closed by means of a covering plate 12 provided with perforations 11. In order to make the space 9 accessible for cleaning purposes, said covering plate is detachably mounted, and for this purpose the periphery thereof is somewhat conical in shape and fits into an undercut groove 10 in the wall of socket 6. The disc-shaped portion 3 of the closing cover has secured to its underside a sealing ring 13, preferably made from rubber or from a resiliently compressible plastics material.

A valve means, generally designated by reference numeral 14, is provided for closing the opening 8. Said valve means is made from a highly resilient material and comprises a ball-shaped portion 15 and a downwardly-projecting pin or stem 16. Lugs 17*a*, 17*b* project laterally from said stem 16 in opposite directions. Said lugs have inclined surfaces as shown in FIG. 1 for a purpose to be described. The normal position of the valve means is apparent from FIG. 1.

The device of the invention also includes an evacuating pump which may be of any suitable type but in the following description will be exemplified by a manually-operated piston pump. Said pump is designated by reference numeral 18 and includes a cylinder 19, preferably made from a plastics material having the resilient properties of polyethylene for example. The lower portion of said cylinder is shaped as a circumferential sealing lip 20 and the inner surface thereof is bevelled or rounded. It is also possible to have the outer surface of the cylinder shaped to sealingly cooperate with an inner surface of the annular flange 35 to be described. A bushing 21 is press-fitted into a hole in the upper end wall of the cylinder, and for this purpose said bushing has at the lower end thereof a circumferential flange 22 which is saw-toothed in cross-section. Preferably the bushing has inwardly extending ribs 23 to guide a piston rod 24 which carries a handle grip 25 at the upper end thereof. The lower end of rod 24 is attached to a piston 27 by means of a plastics rivet or the like, 26. The piston is made from a yieldable resilient material such as polyethylene and has a disc-shaped portion at the periphery of which there is a circumferential lip 28 of frusto-conical shape which diverges upwardly as seen in FIG. 1.

Projections 29 of annular cross-section (See FIG. 2) project from the lowermost portion of cylinder 19 and are preferably as many as the number of the ribs 5 of closing cover 2. A short and radially-directed pin 30 projects from the cylinder wall for a purpose to be described.

Projecting from the upper surface of the disc-shaped wall 3 of the closing cover 2 there is an annular flange 35 which has a bevelled outer surface intended to sealingly cooperate with the inner surface of the lower end of cylinder 19.

The device described operates in the following manner.

The closing cover 2 is placed on top of the jar or can 1 to be evacuated. The pump is pressed downwardly against cover 2 with the lower end of the cylinder 19 surrounding flange 35. The exterior of flange 35 cooperates with the inner end surface of cylinder 19 in such a manner that the cylinder will easily receive the flange. By the continued downward pressing action, however, the cylinder is brought to sealingly engage the outer surface of flange 35, and in order to be able to press down the cylinder to abut against the upper surface of the closing cover 2, the cylinder 19 has to be slightly outwardly deformed, because the unconstrained inner diameter thereof is somewhat smaller than the greatest diameter of flange 35. In this manner an extremely effective sealing action is obtained between the pump and the cover, because a sealing engagement is accomplished between the internal face of the end of the pump cylinder 19 and the outer surface of flange 35, as well as between the end surface of the cylinder 19 and the upper surface of the disc-shaped portion 3 of the cover. Thus a sealing action in two planes, perpendicular to each other is obtained. Any lateral displacement of the pump in relation to the cover is also eliminated, and the pump and cover are effectively locked to each other during the pumping action.

By pumping the handle 25 up and down, with the cylinder 19 pressed against the cover, air is evacuated from the container. By pressing down the cover 2 a sealing action is also established between the closing cover and the upper edge of the container by means of the yielding sealing ring 13. Upon each upward stroke of the piston 27, air is evacuated from the container through the perforations or openings 11 into the space 9, and the valve means 14 is raised, and the air flows into the cylinder 19. The sealing between the piston 27, 28 and the cylinder 19 is extremely efficient, by virtue of the resilient lip 28 which, upon the upward pulling of piston 27, 28, tends to increase the contact thereof with the interior wall of the cylinder. By making the piston as well as the cylinder from a resilient material, the sealing action is further increased and the "self-lubricating" properties of the material make the pump very reliable and durable.

When the handle is moved downwardly, the increasing air pressure in the cylinder 19 assists the atmospheric pressure to hold valve means 14 pressed against its seat. Said valve means 14 is made from a very soft and resilient material, and thus the ball-shaped portion thereof seals against the wall portion 7 surrounding the opening 8. As the wall is planar, and the opening 8 is not conical, a linear contact is established between said ball-shaped portion and said wall. The planar wall 7 is also easily cleaned after removal of the valve means. Since there is no need for a conical seal for the valve means, owing to the softness of the ball-shaped portion thereof, a still further advantage resides in the fact that contamination will not tend to cling to the seat and thus negatively influence the sealing action. The major part of the ball-shaped portion 15 is situated above the wall 7, and is easily accessible, and there is no risk of the valve "biting". The compressed air in the lower part of the pump cylinder also presses lip 28 inwardly such that air may freely pass the piston and the cylinder wall and reach the upper portion of the cylinder, to leave subsequently through the space between the bushing 21 and the piston rod 24. Pumping can be continued until the desired degree of evacuation has been attained.

In order to indicate that the evacuation has reached a predetermined value, the lower end of the pump cylinder 19 is provided with resilient projections 29, as seen in FIG. 1 and FIG. 2. When the pressure in the jar drops, the disc-shaped portion of the cover 2 will be bent downwards due to the external atmospheric pressure, and as a consequence thereof the reinforcing ribs 5 will be deformed such that the free inner ends thereof are radially displaced towards the centre of the cover. As can be seen in FIG. 2, said inner ends **5*a* of the reinforcing ribs 5, when in the starting position, are substantially in engagement with the radially outer surface of the projections 29. As a result of said radial inwards movement of the reinforcing means, the annular portions 29 will be deformed and become oval, and in a certain position an opposite wall thereof will be brought into engagement with the respect projection 30**. When this occurs, the proper degree of evacuation has been attained and the pumping action is halted, the pump is removed and the jar with the associated cover may be stored.

When it is desired to obtain access to the contents of the jar, the ball-shaped portion 15 is touched lightly in order to displace or tilt the valve means, and said operation causes interruption of the sealing connection between the valve means and the cover, which in turn results in air flowing into the jar. The cover may now be removed, and access obtained to the contents of the jar.

In devices to be used in the household it is of course of the utmost importance that all parts may be easily and effectively cleaned. For this purpose the cover plate 12 is easy to remove as mentioned above, and by making the valve body from a very soft and yieldable material it may be removed simply by seizing it by hand and pulling it upwardly. In order to replace the valve means in position again it is sufficient to push it downwards from above, and the oblique lower surfaces of the projections or lugs **17*a*, 17*b*** will then facilitate the deflection thereof to pass through the opening.

The device described above may be varied within the scope of the appended claims. For example the closing cover may be curved rather than planar, and would preferably be convex in shape. If the cover is made from a suitable material such as a sheet metal, it may be dimensioned and shaped in such a manner that, upon achievement of a predetermined sub-atmospheric pressure, the cover moves from a convex to a concave configuration, whereby an indication of the predetermined sub-atmospheric pressure being reached is obtained. In this case, the projections 29, 30 may be omitted.

As seen in FIG. 3 it is also possible to provide a cover made from a suitable material with a preferably circular portion 31 having a considerably thinner wall than the rest of the cover and, according to FIG. 3, said portion is of convex configuration in the unconstrained state. When the desired sub-atmospheric pressure is obtained, the portion snaps over into the convex state, indicated by chain-dotted lines, and with a noise that is easily heard and thus an audio-visual indication that the pumping may be halted is obtained.

It is also possible to provide a safety valve in the cover or pump, said valve being adapted to open upon achieving the intended pressure, thereby making further evacuation impossible.

In order to be able to cover containers of widely different dimensions with a same closing cover, it is possible as seen in FIG. 4 to make said cover in two parts in the shape of an outer cover 33 having a sealing ring 13 in order to seal against the container, and said ring 13 may for example as seen in FIG. 3 be placed between annular ribs 32*a*, 32*b* on the lower surface of the cover. The outer cover is annular and the standard-sized cover to be used for example as shown in FIG. 1 fits into the inner opening thereof. By providing a number of such annular outer covers of different diameters, it is thus possible to evacuate containers of various dimensions.

I claim:

1. In a device, for evacuating air from a container having an opening, of the kind comprising (a) a cover provided with a sealing surface to sealingly engage part of said container which surrounds said opening, said cover having an opening which is closable by means of a valve, and (b) a separable evacuating pump having a cylinder for connection to said cover for evacuating air from said container, the improvement that:

(i) said pump has a plunger including a circular part having an annular sealing lip which is frustoconical and diverges in the direction of movement of the plunger to cause suction, said plunger being made from a resilient plastics material and having such wall-thickness that said sealing lip during the suction stroke is resiliently pressed against the internal face of said cylinder, and during a compression stroke may be deformed by air pressure such that air may pass out of the cylinder between said lip and the cylinder wall;

(ii) said pump cylinder is made from a resilient plastics material;

(iii) said pump cylinder has at a free end thereof in a thin annular lip;

(iv) said cover has on an upper face thereof an annular flange surrounding said opening of the cover, said annular flange serving to sealingly cooperate with said thin annular lip of the pump cylinder when said pump is pressed axially against the cover;

to provide centering of the pump cylinder in relation to the cover and sealing therewith in two planes substantially perpendicular to each other;

(v) wherein said valve has a valve member with a ball-shaped part having a downwardly directed stem to pass with clearance through an opening of a wall of the cover, and two projections projecting from said stem in two opposite directions, said projections being normally located below said wall, the distance between the ends of said projections exceeding the diameter of the hole in the cover so as to prevent unintended removal of said valve, said wall in which said hole is provided having a substantially planar upper surface, said opening being cylindrical and having a comparatively narrow dimension compared to said ball-shaped part such that a major part of said ball-shaped part remains easily accessible above said wall, said valve member being made from a material having such resiliently yielding properties that said ball-shaped part can provide sufficient sealing against said wall surrounding said opening of the cover mainly by linear contact, whereas the projections may be yieldingly deformed for insertion and removal of the valve.

2. The device claimed in claim 1, wherein the projections have sloping entering surfaces.

3. The device claimed in claim 1, wherein the cover has a circular portion with a reduced wall thickness, said portion in unconstrained state bulging outwardly from the upper side of the cover, said portion having such a diameter and wall thickness that it returns from convex to concave shape when a desired subatmospheric pressure has been obtained in the container.

4. The device claimed in claim 3, wherein at least said thin-walled portion is made from a material having resilient properties such that the portion snaps from a convex to a concave shape when the intended degree of vacuum has been obtained.

5. The device claimed in claim 1, wherein the cover has at its upper side a plurality of radially extending reinforcement ribs at least one thereof having near to its end a guide for an indication means.

6. The device claimed in claim 1, wherein said cover has a downwardly directed sleeve-shaped portion which is covered at its under side by means of a perforated, removable cover.

7. The device claimed in claim 1 wherein the cover comprises an inner part having said valve, and an outer annular part having the inner portion thereof supported by said inner part and which has a sealing ring.

* * * * *